US009822637B2

(12) United States Patent
Gorrara

(10) Patent No.: US 9,822,637 B2
(45) Date of Patent: Nov. 21, 2017

(54) METHOD AND APPARATUS FOR TRANSMITTING A MESSAGE IN A WELLBORE

(71) Applicant: NABORS LUX FINANCE 2 SARL, Luxembourg (LU)

(72) Inventor: Andrew Gorrara, Algard (NO)

(73) Assignee: Nabors Lux 2 Sarl, Luxembourg (LU)

( * ) Notice: Subject to any disclaimer, the term of this patent is extended or adjusted under 35 U.S.C. 154(b) by 0 days.

(21) Appl. No.: 15/004,278

(22) Filed: Jan. 22, 2016

(65) Prior Publication Data

US 2016/0215615 A1 Jul. 28, 2016

Related U.S. Application Data

(60) Provisional application No. 62/108,406, filed on Jan. 27, 2015.

(51) Int. Cl.
*E21B 47/18* (2012.01)

(52) U.S. Cl.
CPC ..... *E21B 47/18* (2013.01); *E21B 47/182* (2013.01)

(58) Field of Classification Search
CPC ..... E21B 47/18
USPC ..... 367/82, 83
See application file for complete search history.

(56) References Cited

U.S. PATENT DOCUMENTS 4,215,426 A * 7/1980 Klatt ..... E21B 17/003 175/40
5,249,161 A 9/1993 Jones
5,517,464 A 5/1996 Lerner
5,636,178 A 6/1997 Ritter
5,695,015 A 12/1997 Barr et al.
6,021,095 A * 2/2000 Tubel ..... E21B 23/00 166/166
6,064,695 A 5/2000 Raphaeli
2011/0138809 A1* 6/2011 Ramaswamy ..... F01K 25/10 60/641.2
2012/0127829 A1* 5/2012 Sitka ..... E21B 47/185 367/83
2013/0269951 A1* 10/2013 Tahoun ..... E21B 34/06 166/373
2015/0266463 A1* 9/2015 Atmaram ..... B60W 10/06 701/54

OTHER PUBLICATIONS

Extended European Search Report issued in Application No. 16152720.5, dated Aug. 11, 2016 (7 pages).
Office Action issued in EP App. No. 16152720.5 dated Jul. 17, 2017 (5 pages).

* cited by examiner

*Primary Examiner* — Santiago Garcia
(74) *Attorney, Agent, or Firm* — Adolph Locklar

(57) ABSTRACT

A message to be sent from a downhole tool in a wellbore is modulated into a data uplink signal of pressure variations in the drill string. The pressure variations are generated by varying the torque on the rotor of the generator by varying the electric load on the generator. The pressure variation sequence of the data uplink signal may be selected from a look up table of known sequences. The message may be received by a surface receiver using one or more pressure sensors. The message may be demodulated from the detected pressure data using digital and analog signal processing. The frequency of the data uplink signal may be selected based in part on detected noise in the wellbore. The data uplink signal may be modulated using a spread spectrum protocol.

22 Claims, 4 Drawing Sheets

METHOD AND APPARATUS FOR TRANSMITTING A MESSAGE IN A WELLBORE

CROSS-REFERENCE TO RELATED APPLICATIONS

This application is a nonprovisional application which claims priority from U.S. provisional application No. 62/108,406, filed Jan. 27, 2015, the entirety of which is incorporated herein by reference.

TECHNICAL FIELD/FIELD OF THE DISCLOSURE

The present disclosure relates generally to wellbore communications and more specifically to transmitting data between a downhole location and the surface.

BACKGROUND OF THE DISCLOSURE

During a drilling operation, data may be transmitted and instructions may be received by a downhole tool included as part of a drill string positioned in a wellbore. Typically, a drill string will include a bottom hole assembly (BHA) which may include sensors positioned to track the progression of the wellbore or measure or log wellbore parameters. The BHA may also include steerable drilling systems such as a rotary steerable system (RSS) which may be used to steer the wellbore as it is drilled. Often, a BHA will include a power source such as a turbine generator to power its components. By remaining in communication with the BHA, a user may have access to the data collected by the sensors and may be able to send instructions to the RSS.

Due to the length of the wellbore, which may be up to 30,000 feet or more, achieving reliable communications may be difficult. For example, the composition of the surrounding formation and any intervening formation may prevent electromagnetic or radio frequency signals from reaching the surface from the downhole tool. Typically mud pulse tools use a series of pressure pulses generated in the wellbore by a downhole mud pulse tool to transmit data to the surface. However, mud pulse tools add length, complexity, and expense to the drill string.

SUMMARY

The present disclosure provides for a method for transmitting a signal from a downhole tool having a turbine generator. The method may include flowing a fluid through the turbine generator, determining a message to be transmitted by a control unit coupled to the turbine generator, and transmitting the message. The message may be transmitted by varying the load on at least one turbine of the turbine generator to modulate the message onto the pressure drop across the turbine generator.

The present disclosure also provides for a method for transmitting a message from a downhole tool having a turbine generator to the surface. The method may include positioning the downhole tool on a drill string. The drill string may extend through a wellbore to the surface. The method may also include coupling at least one sensor adapted to detect pressure variations in the drill string at the surface of the drill string, flowing a fluid through the turbine generator, generating, by a control unit, a message to be transmitted, and transmitting the message. The message may be transmitted by varying the load on the coils of at least one turbine of the turbine generator to modulate the message onto the pressure drop across the turbine generator. The method may also include measuring, with the sensor, a pressure signal from the drill string; and demodulating the message from the pressure signal by a surface receiver.

The present disclosure also provides for a system for transmitting a message from a location within a wellbore to the surface. The system may include a downhole tool coupled to a drill string located within the wellbore. The downhole tool may include a turbine generator. The turbine generator may have a turbine adapted to rotate in response to the movement of fluid through the turbine generator, one or more windings, and one or more permanent magnets coupled to the turbine adapted to induce current in the one or more windings as the turbine rotates. The downhole tool may further include a control unit. The control unit may be coupled to the output of the windings. The control unit may be adapted to modulate the message into a sequence of pressure variations, the pressure variations generated by varying the electric load on the generator to modulate the speed of rotation of the turbine. The system may further include a surface receiver. The surface receiver may include at least one pressure sensor coupled to the drill string adapted to detect the pressure in the drill string. The surface receiver may be adapted to demodulate the message from the detected pressure signal.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
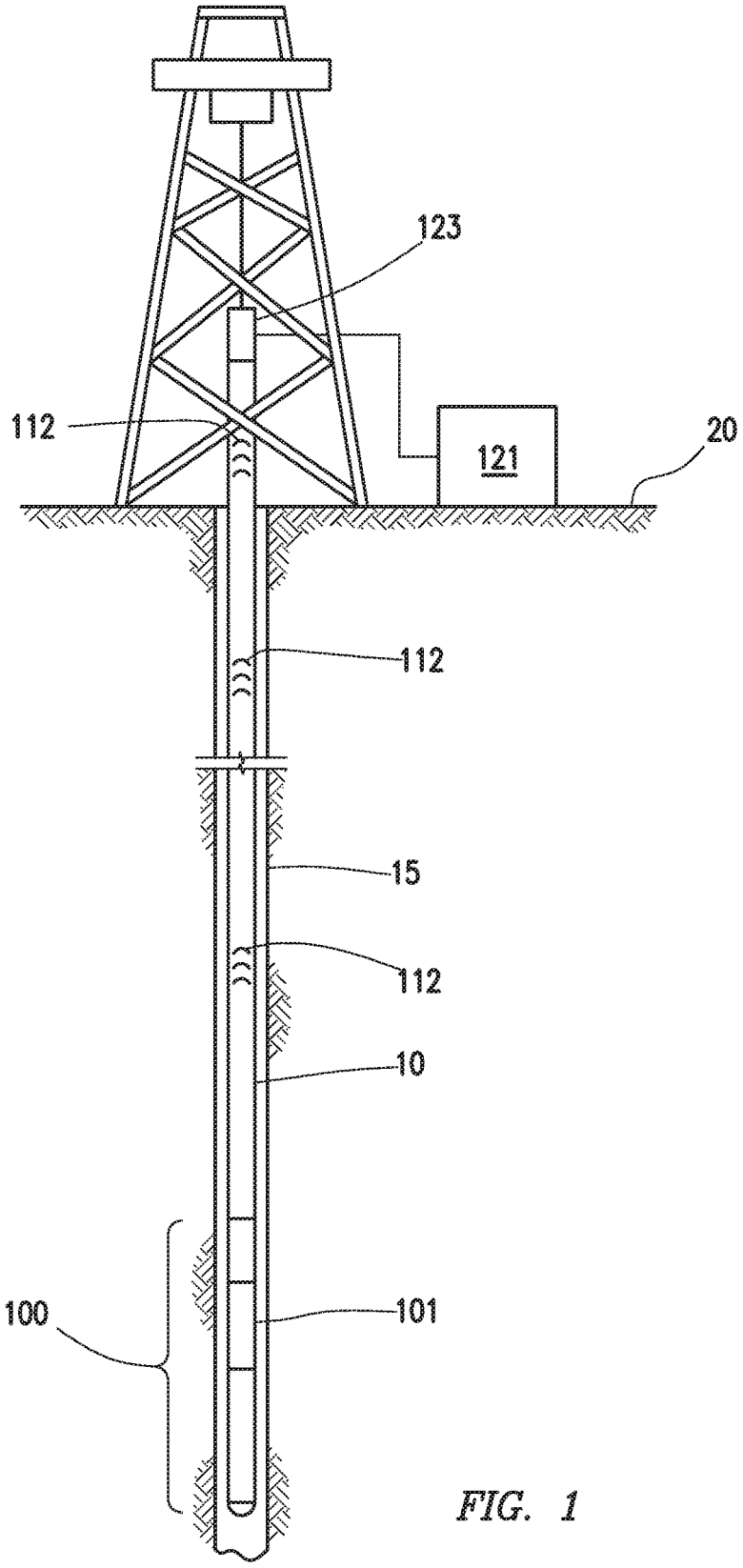
FIG. 1 is a schematic view of a drilling operation including a generator sub consistent with embodiments of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Figure 2:
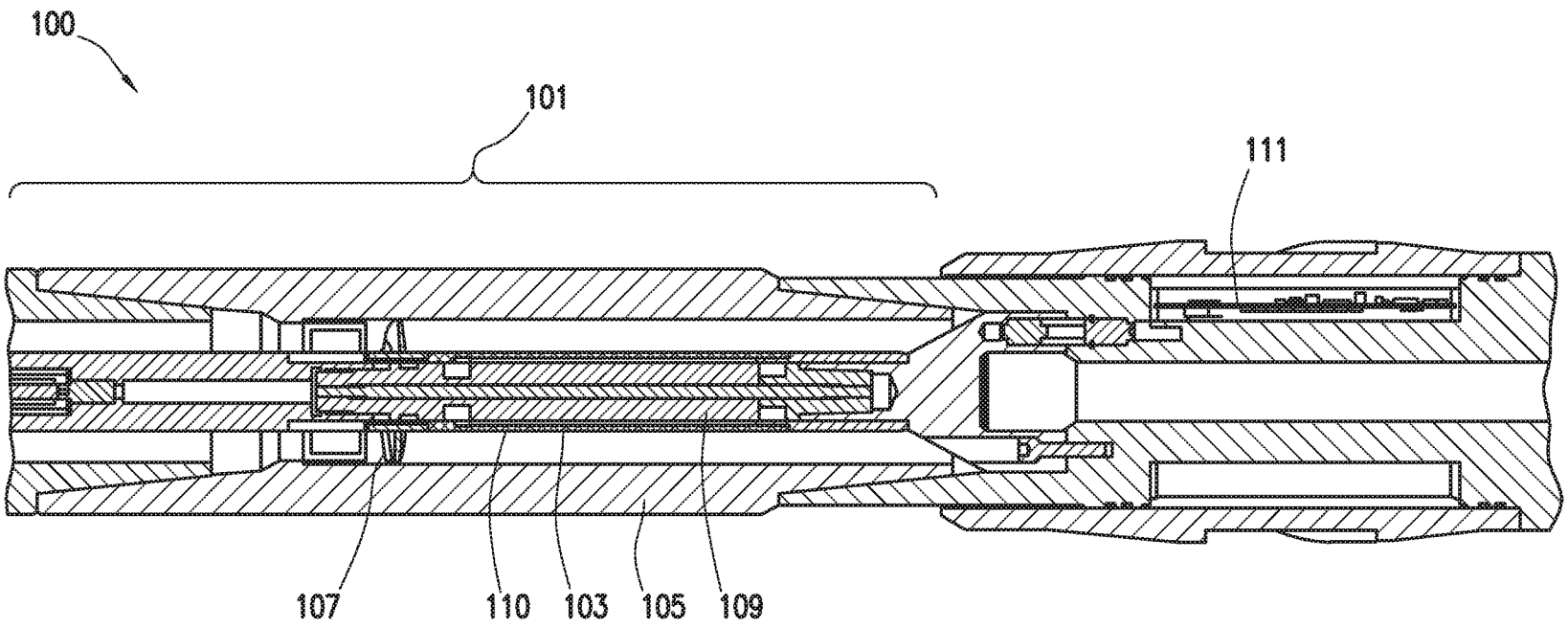
FIG. 2 is a cross section view of a generator sub consistent with embodiments of the present disclosure.

FIG. 1 depicts wellbore 15. Bottom hole assembly (BHA) 100 may be coupled to drill string 10. Drill string 10 may extend from surface 20 through wellbore 15. Drill string 10 may be generally tubular and may have a fluid positioned therein. BHA 100 may, include generator 101. In some embodiments, generator 101 may be a turbine generator. In some embodiments, as depicted in FIG. 2, generator 101 may include rotor 103 positioned within generator sub 105. Rotor 103 may include turbine 107 and may rotate within generator sub 105 in response to the flow of a fluid therethrough. Generator 101 may include one or more sets of windings 109 adapted to interact with a rotating magnetic field generated by one or more magnets 110 coupled to rotor 103 to inductively induce voltages that produce electric current therein. One having ordinary skill in the art with the benefit of this disclosure will understand that any winding arrangement may be used including, for example and without limitation, single or multiple phase arrangements. In some embodiments, windings 109 may be arranged in a three-phase arrangement, providing three-phase power to BHA 100.

Figure 3:
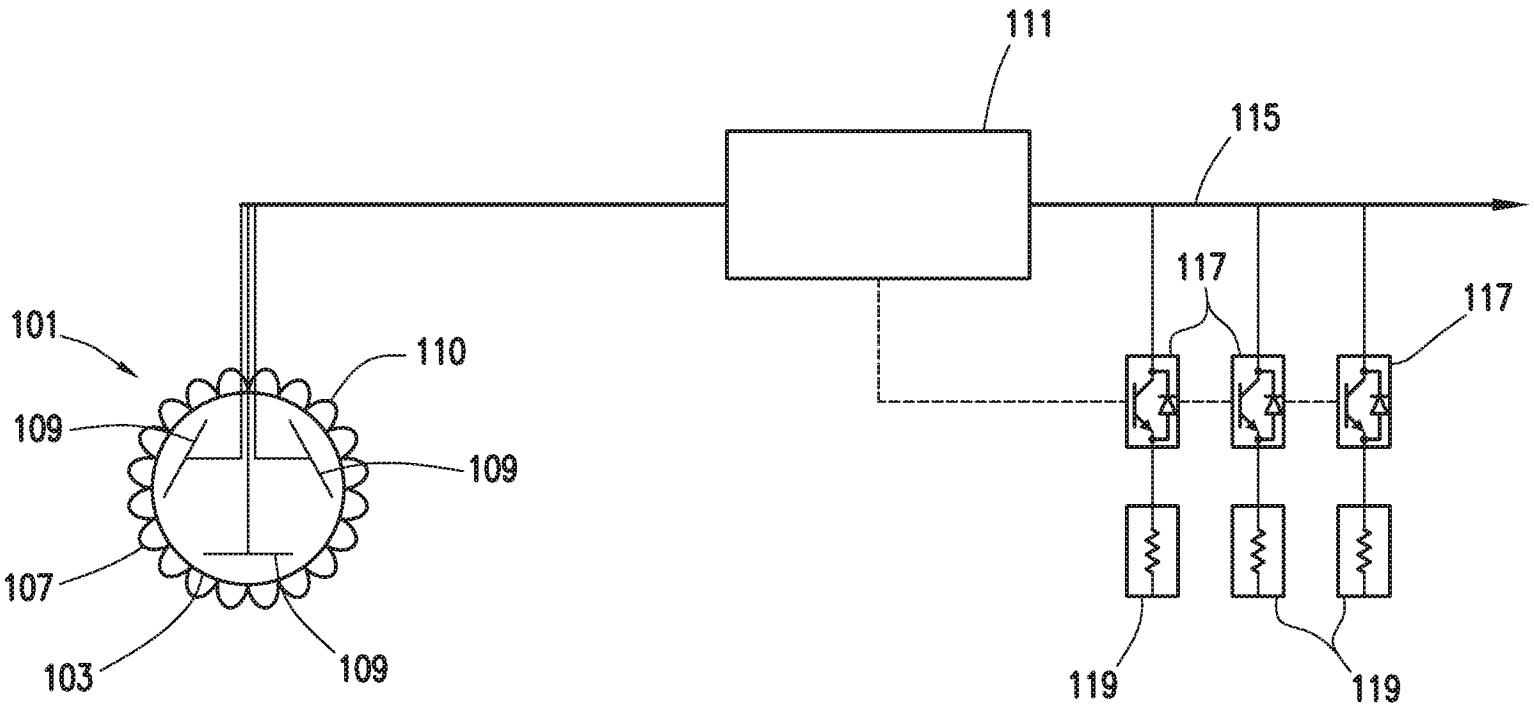
FIG. 3 is a schematic view of the generator sub of FIG. 2.

Generator 101 may be coupled to control unit 111. Control unit 111 may receive power from generator 101 and may provide electric power to other components of BHA 100 through power bus 115, such as, for example and without limitation, a measurement while drilling (MWD) system, logging while drilling (LWD) system, a rotary steerable system (RSS), or any other electrically driven component. In some embodiments, control unit 111 may vary the electric load on generator 101 to generate one or more pressure pulses 112 via a torque coupling between the rotor and the stator (as depicted in FIG. 1) in the mud column in drill string 10 as further discussed herein below. As depicted in FIG. 3, in some embodiments, control unit 111 may be coupled to one or more switches 117 which may electrically couple one or more load banks 113 to power bus 115. Switches 117 may be any electrically switchable device, including, for example and without limitation, transistors, triacs, or, as depicted in FIG. 3, choppers. By increasing the electric load on windings 109, an additional torque load may be added to rotor 103, resulting in a change in the pressure drop across turbine 107. By selectively coupling and decoupling load banks 113 control unit 111 may be able to modulate a data uplink signal onto the pressure drop across turbine 107 in the form of pressure pulses 112 in drill string 10.

As depicted in FIG. 1, pressure pulses 112 of data uplink signal may be received by surface receiver 121. Surface receiver 121 may include one or more sensors adapted to detect the pressure of the fluid in the drill string 10. Sensors may include, for example and without limitation, one or more pressure sensors 123, flow sensors, or force sensors adapted to detect drill string pressure. In some embodiments, pressure sensors 123 may detect a single pressure or, in the case of multiple pressure sensors 123, may detect a differential pressure. In some embodiments, multiple pressure sensors 123, which, in certain embodiments, may be arranged in an array. Multiple pressure sensor 123 may be used to enable direction and source of noise within the wellbore to be identified and cancelled, by such methods known by those of skill in the art with the benefit of this disclosure. Once the pressure data is received by surface receiver 121, the pressure data may be processed and demodulated to retrieve the uplink signal as discussed below.

One having ordinary skill in the art with the benefit of this disclosure will understand that the pressure data received by surface receiver 121 may include noise generated by, for example and without limitation, mud pumps, mud motors, mud pulse telemetry systems, and rotary pulse interference. The pressure signal may also include noise caused by physical changes in the drill string and hydraulic channel between surface receiver 121 and BHA 100. Furthermore, the overall pressure detected by surface receiver 121 is dependent on, for example and without limitation, the pump rate of the fluid in the drill string, the diameters of the drill string and wellbore, and the configuration of tools included in the drill string. Thus, the ratio of the power of the data uplink signal to the noise in the drill string, the signal-to-noise ratio (SNR), may be very low.

The data uplink signal may be modulated utilizing one or more modulation schemes. In some embodiments, the data uplink signal may be modulated utilizing a spread spectrum modulation. Spread spectrum, as understood in the art, utilizes multiple or varying frequencies to improve the probability of receiving a signal in a poor SNR environment. A further discussion of spread spectrum theory is discussed in U.S. Pat. No. 6,064,695, the entirety of which is hereby incorporated by reference.

In some embodiments, the data uplink signal may include, for example and without limitation, data received from sensors included in BHA 100. In some embodiments, the data uplink signal may include status messages relating to tools included in BHA 100. For example and without limitation, status messages may include acknowledge (ACK) or not acknowledge (NAK) signals from an RSS or other downhole tool. ACK and NAK signals may be used to inform a surface station receiver whether or not a command was properly received. In some embodiments, NAK signals may be transmitted at regular intervals to, for example and without limitation, confirm proper operation of BHA 100 when no communication is otherwise available.

Status messages may include messages relating to the operational status of the tool or certain conditions in the wellbore. In some embodiments, status messages may be selected from a lookup table of known messages to, for example and without limitation, minimize the amount of transmitted data necessary to convey the status message. Additionally, the messages may be chosen to, for example and without limitation, maximize the ability for the surface receiver to recover the message. In some embodiments, as understood in the art, each message sequence may be a maximum length sequence or gold code sequence. In some embodiments, a transmitted message may be preceded by a fixed length known sequence (commonly referred to as a Barker sequence). The Barker sequence may be constructed such that it is easy for surface receiver 121 to recognize and may be used for signal synchronization purposes.

In some embodiments, the frequency selected for the data uplink signal may be determined based at least in part on anticipated attenuation, wellbore noise, and other transmissions in the wellbore. For example, high frequency pressure modulations may be highly attenuated based on the physical makeup of the fluid channel between BHA 100 and surface receiver 121. In some embodiments, for example and without limitation, the data uplink signal frequency may be between 0.05 and 5 Hz, between 0.1 and 1 Hz, or between 0.2 and 0.5 Hz.

In some embodiments, using known operating frequencies of other pressure pulse signal transmissions from other downhole tools, including, for example and without limitation, mud pulse telemetry units, the frequency of the uplink data signal may be selected to avoid interference with or being interfered with by the other transmissions.

In some embodiments, control unit 111 may be coupled to one or more sensors adapted to sample wellbore noise. By determining, a relatively quiet frequency range from the frequency spectrum of the wellbore noise, the SNR of the data uplink signal may be optimized.

Due to changing conditions in the wellbore during a drilling operation, the frequency spectrum of the wellbore noise may change over time. For example, changes in drilling operation, drilling fluid density, drilling fluid viscosity, temperature, well depth, weight on bit, or other anomalies may each contribute to a change in the wellbore noise frequency spectrum. In some embodiments, the frequency selected for the data uplink signal may be changed in response to a change in wellbore noise. In some such embodiments, control unit 111 may periodically or continuously monitor the wellbore noise spectrum, using this analysis to dynamically adapt the frequency of the data uplink signal to, for example and without limitation, improve the SNR.

In operation, when control unit 111 has determined a message to be transmitted to the surface, control unit 111 may modulate the message into a pressure signal by varying the load on the generator windings 109, and thereby causing the torque required to rotate rotor 103 to change, thus varying the pressure drop across the rotor to vary in proportion to the load. as discussed above. In some embodiments, control unit 111 may modulate the message into the pressure signal using a pseudo noise signal. The resulting pressure signal, the data uplink signal, travels through the drill string to surface receiver 121, which proceeds to demodulate the data uplink signal to retrieve the message. Surface receiver 121 may demodulate the data uplink signal by any known method. In some embodiments, surface receiver 121 and turbine 107 may be phase synchronized prior to turbine 107 being placed within the wellbore. Electronically, surface receiver 121 and control 11 may be phase synchronized prior to control unit 111 being placed within the wellbore. This phase synchronization may be accomplished to improve demodulation.

Figure 4:
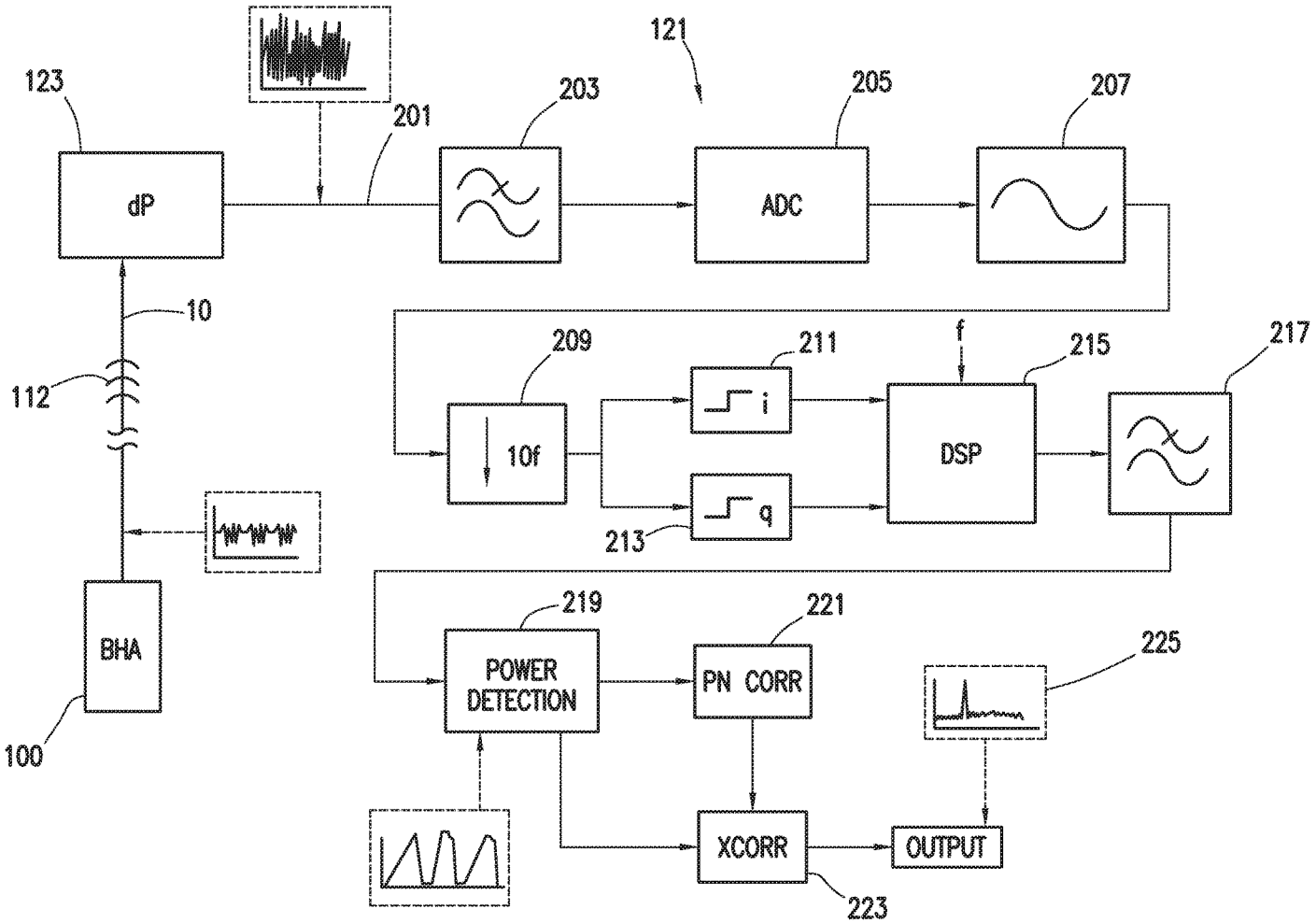
FIG. 4 is a process-flow of a demodulation operation consistent with embodiments of the present disclosure.

As an example provided for explanatory purposes and without any limitation to the scope of the present disclosure, an example surface receiver signal processing operation is depicted in FIG. 4. The analog pressure signal 201 measured by pressure sensors 123 may first pass through one or more low pass filters 203. The resulting signal may then be digitized by analog to digital converter (ADC) 205. In some embodiments, ADC 205 may have a sample rate higher than the frequency of the data uplink signal, a process commonly referred to as oversampling. The digital data may then be passed through a series of digital filters 207. The digital data may then be downsampled 209 to, for example and without limitation, about 10 times the frequency of the data uplink signal or less. In some embodiments, the digital data may be split to identify in-phase 211 and quadrature components 213, allowing for the signal to be demodulated by software multiplication (digital signal processor 215) using the frequency of the data uplink signal. The signal may then be again filtered 217 to, for example, remove unwanted higher frequency data. This filtered signal may be continuously monitored for power level (by power detection circuit 219) to, for example and without limitation, allow for phase correction of the system with any received signals. Additionally, where the data uplink signal frequency is adapted in response to noise conditions as discussed above, by monitoring the frequency spectrum of the filtered signal, the frequency of the data uplink signal may be identified. Likewise, surface receiver 121 may generate a continuous estimate of background noise level. The filtered signal may also, in some embodiments, be passed into a pseudo noise correlator 221. When power levels increase as indicated by power detection circuit 219, pseudo noise correlator 221 may output a known sequence to power detection circuit 219 in order to match the received sequence to a library of known messages by cross-correlation. By cross-correlating (at 223) the known sequence, the received sequence may be identified (at 225).

Although described herein as using generator sub 101 with a single turbine 107, one having ordinary skill in the art with the benefit of this disclosure will understand that any arrangement of downhole generator may be utilized. In some embodiments, generator sub 101 may further include a second turbine electromagnetically coupled to control unit 111 to, for example and without limitation, increase the pressure drop created by the modulation of rotor 105 by modulating the second turbine synchronously with turbine 107. In some embodiments, one or more static flow deflectors may be included prior to turbine 107 to, for example and without limitation, direct the flow of the fluid at an appropriate angle to the rotating blades of turbine 107.

Additionally, although described herein as part of a bottom hole assembly, one having ordinary skill in the art with the benefit of this disclosure will understand that the methods described herein may be used with any generator sub located at any point on a drill string or other tool string.

As previously discussed, in some embodiments, generator sub 101 may be a standard downhole turbine generator. In some embodiments, generator sub 101 may be modified to transmit the data uplink signal as described herein by retrofitting a control unit 111 configured as previously discussed.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A method for transmitting a signal comprising:

providing a downhole tool having a turbine generator, the turbine generator having a turbine;

flowing a fluid through the turbine generator; and transmitting a message by varying the torque load on the turbine to modulate the message onto the pressure drop across the turbine generator.

2. The method of claim 1, wherein the transmitted message comprises a pressure pulse sequence having a first transmission frequency.

3. The method of claim 2, wherein the first transmission frequency is between 0.1 and 1 Hz.

4. The method of claim 2, wherein the pressure pulse sequence is selected from a lookup table of known pressure pulse sequences.

5. The method of claim 4, wherein the known pressure pulse sequences are pseudo noise sequences.

6. The method of claim 2, wherein the pressure pulse sequence is a maximum length sequence or a gold code sequence.

7. The method of claim 2, wherein the message is modulated utilizing a spread spectrum modulation.

8. The method of claim 2, further comprising:

monitoring the frequency spectrum of the ambient noise by the control unit at a first time interval;

identifying a relatively quiet frequency range;

selecting the first frequency corresponding to the relatively quiet frequency range; and transmitting the message at the first transmission frequency.

9. The method of claim 8, further comprising:

monitoring the frequency spectrum of the ambient noise by the control unit at a second time interval;

identifying a second relatively quiet frequency range;

selecting a second transmission frequency corresponding to the second relatively quiet frequency range; and transmitting a second message at the selected second transmission frequency.

10. The method of claim 1, further comprising:

positioning a second turbine generally within the turbine generator, the second turbine adapted to rotate in response to fluid flow through the turbine generator, the second turbine electromagnetically coupled to the control unit; and varying the load on the second turbine synchronously with the turbine of the turbine generator.

11. The method of claim 1, further comprising:

measuring a pressure signal at a location spaced apart from the turbine generator, the pressure signal including at least the modulated message; and demodulating the message from the pressure signal.

12. The method of claim 11, wherein the measured pressure signal further comprises noise, and the demodulating operation further comprises:

removing the noise from the pressure signal.

13. The method of claim 12, wherein the noise is removed by one or more analog filtering, digital filtering, and digital signal processing operations.

14. The method of claim 11, wherein the demodulating operation further comprises:

cross-correlating one or more sequences of the pressure signal with one or more known messages; and identifying a known message of the known messages in the pressure signal.

15. The method of claim 1, wherein the speed of the turbine generator is varied by modulating the electrical load of the turbine generator.

16. The method of claim 15, wherein the electrical load is modulated by selectively coupling or decoupling one or more load banks to the power output of the turbine generator.

17. The method of claim 1, wherein the message is transmitted to acknowledge successful receipt of an instruction received by the control unit.

18. The method of claim 1, wherein the message is transmitted at a regular interval to indicate that no instruction was received by the control unit in a previous time interval.

19. A method for transmitting a message from a downhole tool having a turbine generator to a surface receiver comprising:

positioning the downhole tool on a drill string, the drill string extending through a wellbore to the surface;

coupling at least one sensor adapted to detect pressure variations in the drill string at the surface of the drill string;

flowing a fluid through the turbine generator;

generating, by a control unit, a message to be transmitted;

transmitting the message by varying the load on the coils of at least one turbine of the turbine generator to modulate the message onto the pressure drop across the turbine generator;

measuring, with the sensor, a pressure signal from the drill string; and demodulating the message from the pressure signal by the surface receiver.

20. The method of claim 19, further comprising prior to the step of positioning the downhole tool on a drill string, phase synchronizing the turbine and surface receiver.

21. A system for transmitting a message from a location within a wellbore to the surface comprising:

a downhole tool coupled to a drill string located within the wellbore, the downhole tool including:

a turbine generator having:

a turbine adapted to rotate in response to the movement of fluid through the turbine generator;

one or more windings; and one or more permanent magnets coupled to the turbine adapted to induce current in the one or more windings as the turbine rotates; and a control unit, the control unit coupled to the output of the windings, the control unit adapted to modulate the message into a sequence of pressure variations, the pressure variations generated by varying the electric load on the generator to modulate the speed of rotation of the turbine; and a surface receiver, the surface receiver including at least one pressure sensor coupled to the drill string adapted to detect the pressure in the drill string, the surface receiver adapted to demodulate the message from the detected pressure signal.

22. The method of claim 21, wherein the surface receiver comprises a plurality of pressure sensors, the plurality of pressure sensors adapted to determine direction and source of noise within the wellbore.

* * * * *